United States Patent [19]

Kunioka et al.

[11] 4,050,963

[45] Sept. 27, 1977

[54] METHOD OF QUENCHING LARGE-DIAMETER THIN-WALL METAL PIPE

[75] Inventors: Kazuo Kunioka, Yokohama; Yutaka Mihara, Tokyo; Takao Noguchi, Yokohama, all of Japan

[73] Assignee: Nippon Kokan Kabushiki Kaisha, Tokyo, Japan

[21] Appl. No.: 652,576

[22] Filed: Jan. 26, 1976

[30] Foreign Application Priority Data

Jan. 31, 1975 Japan ..... 50-12380

[51] Int. Cl.[2] ..... C21D 9/08

[52] U.S. Cl. ..... 148/128; 73/89; 148/130; 148/131; 148/143; 148/153

[58] Field of Search ..... 148/128, 130, 131, 143, 148/153; 73/15.6, 89

[56] References Cited

U.S. PATENT DOCUMENTS 3,708,354 1/1973 Rowell ..... 148/128

*Primary Examiner*—R. Dean

[57] ABSTRACT

A method of quenching a large-diameter thin-walled metal pipe includes the steps of moving the metal pipe through a heating zone and passing the pipe through a cooling zone following passage of the pipe through the heating zone. The cooling zone includes a plurality of nozzles for spraying a cooling liquid onto the pipe from the nozzles, so as to quench the pipe. The process steps further include detecting the amount of strain on the outer periphery of the quenched pipe at the rear end of the cooling zone, as seen in the direction of movement of the pipe, so as to obtain a deviation of a detected value from a preset value, and adjusting the amount of cooling liquid sprayed onto the pipe from the nozzles in accordance with the amount of deviation from the preset value, so that the adjusted cooling water spray controls the deviation of pipe emerging from the cooling zone, for example, reduces the eccentricity of a circular pipe.

8 Claims, 10 Drawing Figures

AMOUNT OF DISTORTION FROM EXACT ROUND SHAPE in mm

AMOUNT OF DISTORTION FROM EXACT ROUND SHAPE in mm

METHOD OF QUENCHING LARGE-DIAMETER THIN-WALL METAL PIPE

BACKGROUND OF THE INVENTION

The present invention relates to a method of quenching large-diameter thin-wall metal pipe.

When a large-diameter thin-wall metal pipe is to be quenched, the pipe cannot be heated uniformly due to such factors as the type of heating furnace, heating temperature, holding temperature and wall thickness of pipe to be heated, with the result that even if a crude pipe of an exact round shape is fed to the heating furnace, when the pipe leaves the heating furnace, the pipe does not always retain the exact roundness and the pipe, as such, is transferred to the cooling stage thus producing a distorted pipe. In addition to this problem, there is a difficult problem of uniformly cooling the pipe, that is, due to different cooling rates at different parts of the pipe, the pipe is cooled non-uniformly causing deformation of the pipe due to the thermal strain and transformation strain. The present invention is intended to overcome such drawbacks caused during the heat treatment of pipe.

To quench a large-diameter thin-wall metal pipe by passing the pipe from a heating zone to a cooling zone, as shown in FIGS. 1*a* and 1*b*, a metal pipe 10 which has been heated by a heater 9, is moved at a constant speed in the direction of an arrow and an inclined spray of cooling water is directed against the outer periphery of the pipe from a plurality of ring nozzle pipes 14 having cooling nozzles which are arranged in multiple stages. In this case, the upper surface stream of the inclined water jets in the axial direction of the pipe runs down along the pipe wall to the lower surface and the amount of the cooling water at the lower part of the pipe is substantially increased, causing a corresponding increase in the cooling rate of the lower part of the pipe and thereby causing non-uniform distribution of cooling along the circumference of the pipe. This is undesirable from the quality control point of view, since the pipe is distorted in both the longitudinal and radial directions thereof. FIG. 2 shows the distribution of the cooling rates in the temperature range of 800° to 400° C in the circumferential direction of the pipe, which was obtained when the metal pipe having an outer diameter of 24 inches and a wall thickness of ½ inches was moved at a feeding speed of 300 mm/min and cooled by the method shown in FIG. 1, and the above-mentioned non-uniformity of the cooling is evident from this Figure. If the flow velocity of jet water is increased to overcome such non-uniformity of cooling, and when the flow velocity becomes above 8 to 10 m/sec, the water jets can produce no useful cooling effect, since the water jets directed against the pipe periphery are reflected, so that the reflected stream of water and the jet water from the next stage ring nozzle pipe interfer with one another, and the next stage jet water is damped and disturbed by this interference. On the other hand, where, during the heat treatment of a metal pipe, the pipe is cooled to the desired temperature at a high cooling rate, or when the pipe is cooled while moving it at a high feeding speed, a long cooling zone or a multiple stage arrangement of cooling water nozzle pipes is required, and moreover the number of stages in the arrangement must be increased in proportion to the wall thickness of the pipe. However, since such arrangement also gives rise to the similar non-uniformity of cooling, etc., and the resulting distortion in the pipe as was the case with the previously mentioned conventional method, a method of mechanically correcting such distortion by means of pinch rolls or the like has been attempted. However, since the hardness of a quenched metal is very high, making the correction of the cold metal difficult, and in the case of steel pipe its quenching produces such hardened structure as martensite or bainite, particularly in the case of large-diameter pipe, it is necessary to provide an extensive correcting equipment and hence a huge amount of costly equipment is required.

SUMMARY OF THE INVENTION

With a view to overcoming the foregoing deficiency, it is the object of the present invention to provide an improved quenching method for producing a quenched large diameter thin-wall metal pipe of a correct product shape, wherein the strain on the pipe is detected at a plurality of positions on the outer periphery of the pipe in the rear part of the cooling zone, and the amount of cooling water sprayed from cooling nozzles is controlled in accordance with the detected amount of strain with, or without the additional control of the correcting force of the mechanical correcting device.

DESCRIPTION OF THE PREFERRED EMBODIMENTS

Figure 1:
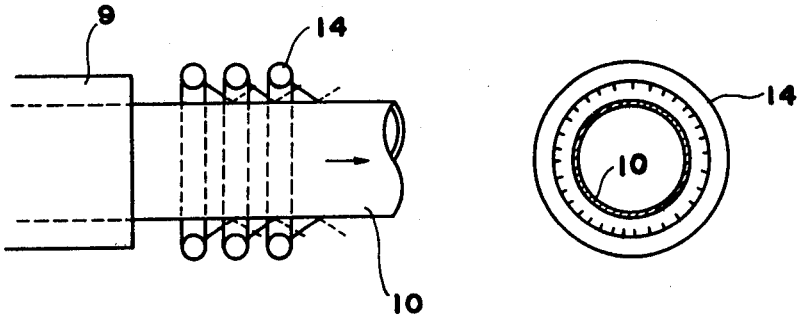
FIGS. 1*a* and 1*b* show a prior art equipment for quenching a large-diameter thin-wall metal pipe 10, particularly a plurality of ring nozzle pipes 14 having cooling nozzles which are arranged in multiple stages.
Figure 2:
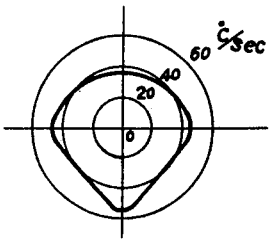
FIG. 2 is a diagram showing the non-uniformity of cooling rate in the prior art equipment, namely, nonuniformity in the rate of cooling by a row of the nozzle pipes having the average cooling rate of about 40° C/sec, and it is needless to say that a similar graph would result even though any other rate of average cooling velocity were used.

The present invention will now be described in greater detail with reference to the illustrated embodiments.

Referring to FIGS. 3, 4a, 4b, 5 and 7, after a metal pipe 10 to be quenched has been heated in a heater 9, the pipe 10 is moved in the direction of an arrow by means of front pinch rolls 8 and back pinch rolls 6, and it is cooled as desired on both the inside and outside thereof with cooling water in a cooling zone 15 comprising an outer first-stage nozzle pipe 1, an outer second-stage nozzle pipe 2, an outer auxiliary nozzle pipe 2", outer third-stage nozzle pipe 2', an inner first-stage nozzle pipe 3, and an inner second-stage nozzle pipe 4. The amount of cooling water from the nozzles directed against a plurality of positions 18 on the periphery of the pipe 10 is adjustable as desired. A plurality of strain detectors 5, each detector having a sensing element 5", the latter being at a plurality of positions 5' around the outer periphery of the pipe in front of the back pinch rolls 6, are connected to non-illustrated associated cooling water solenoid valves for the spray nozzles to control the valves in accordance with the deviation from a predetermined value of the strain detected by the detectors and adjust the amount of cooling water from the nozzles. The detectors 5 are also connected to associated clamping hydraulic cylinders 7 of the back pinch rolls 6, best seen in FIG. 7, so that in a similar manner the clamping force of the hydraulic cylinder 7 is controlled in accordance with the value of the detected deviation, and in this way the desired corrective force is applied to a plurality of positions 16 on the periphery of the pipe 10. While the above-mentioned cooling in the cooling zone 15 may be effected on either the inner or outer periphery or both of the pipe 10, the selection is made in consideration of the desired mechanical properties, wall thickness, easiness of quenching operation, etc., of the pipe 10, and the various requisite conditions can be easily met in that the quenching of a metal pipe having a relatively thin wall thickness can be satisfactorily completed by cooling only one side of the pipe 10, a metal pipe having a thick wall thickness must be cooled from both sides of the pipe, a metal pipe whose inner surface layer must be hardened, as in the case of a pipe for pneumatic conveyor, need not be hardened throughout its wall thickness, and so on. As regards the arrangement of a plurality of outer multistage nozzle pipes, while these pipes may be arranged in the similar manner as conventional ring nozzle pipes, their arrangement may also take such a form that it is possible to adjust and control the amount of cooling water from each of the nozzles, and the flow velocity of cooling water must also be controlled, as desired, within the range of 0.5 to 7 m/sec.

In other words, with the flow velocity of less than 0.5 m/sec, the cooling jet water can not reach the lower surface of the pipe, whereas when the flow velocity is above 7 m/sec the reflected cooling jet water from the preceeding nozzle and the cooling jet water from the following nozzles interfere with one another thus making it difficult to ensure the desired uniform cooling. With the flow velocity below 7 m/sec, the kinetic energy of the jet water is within the control of the surface energy of water, and the jet water as well as the water stream after impingement remain laminar, thus enlarging the cooling zone 15, i.e. the area of a uniformly cooled surface, preventing the occurrence of reflected jet water, and hence the occurrence of mutual interference of water jets.

Figure 3:
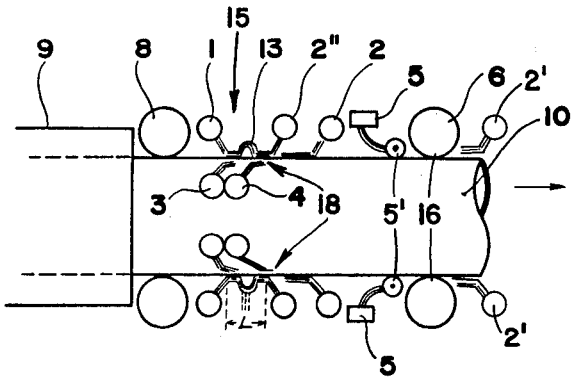
FIG. 3 is a schematic diagram for explaining a method according to the invention.
Figure 4:
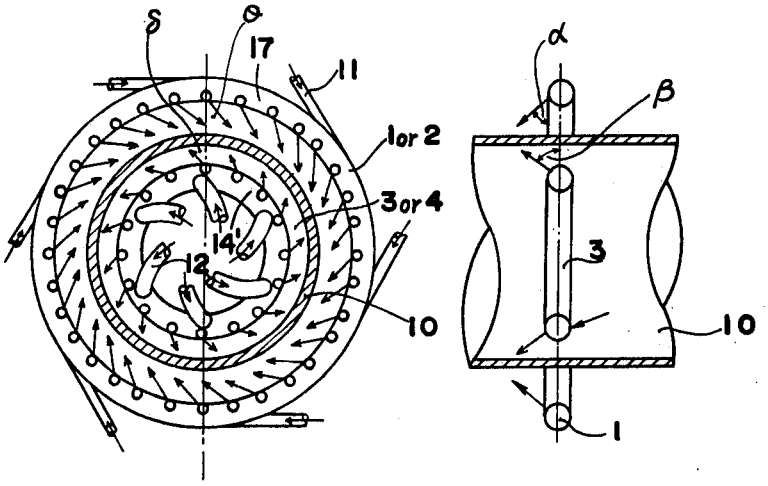
FIGS. 4*a* and 4*b* are diagrams showing an example of a cooling system for ensuring the desired uniform cooling and the flow deflections of cooling jet water from the system, only nozzles 1 and 3 being shown for the sake of clarity in FIG. 4(b)

The outer nozzle pipe at each stage will now be described in greater detail. As will be seen from FIG. 4, a ring shaped tube 17 which is concentric with the metal pipe 10 is arranged in place, and a plurality of cooling water inlet ducts 11 is provided at equal intervals on the tube 17 substantially tangentially to its outer wall, so that the cooling water which has been circulated in the tube 17 is sprayed through a plurality of nozzles, each having a dip angle $\alpha$ to the axis of the metal pipe 10, and a horizontal angle $\theta$ to the radius of the metal pipe. By virtue of the dip angle $\alpha$, the cooling jet water from the outer first-stage nozzle pipe 1 is prevented from returning in a direction opposite to the direction of travel of the pipe 10, while by virtue of the horizontal angle $\theta$ the cooling jet water covers the outer periphery of the pipe, while flowing in a circle thus increasing the cooling area. On the other hand, the second-stage nozzle pipe 2 is arranged in such a manner that the direction of jets from the first-stage nozzle pipe 1 is opposite to that of the second-stage pipe 2, so that, as shown in FIG. 3, the water jets strike against one another and result in a swell 13 between the stages to linearly enclose the outer periphery of the pipe 10 and thereby allow the cooling water above the swell 13 to run down and cool the pipe 10 uniformly. This uniform cooling effect is improved further synergistically by virtue of the fact that the orifice of each of the nozzles at the respective stages subtends a horizontal angle to the radius of the pipe. Referring now to the inner nozzle pipes at the respective stages, as will be seen from FIG. 4, in a similar manner as the above-mentioned outer nozzle pipes, a concentric ring-shaped tube 14" is mounted inside the metal pipe 10, and a plurality of cooling water inlet ducts 12 are provided on the tube 14' nearly tangentially thereto. The orifice of each nozzle is similarly designed to have an elevation angle $\beta$ and horizontal angle $\delta$ respectively to the axis and radius of the metal pipe 10, thus producing substantially the same effects as in the case of the outer nozzle pipes. In this case, it is preferable to increase the flow velocity of cooling water by spraying the cooling water from the nozzle orifices under high pressure, or by atomizing a mixture of water and compressed gas and the effect of this is that contrary to the cooling of the outer periphery the reflected stream of the jet water impinges against the inner wall of the pipe 10 by centrifugal force, and in this way the occurrence of mutual interference of water jets due to their multistage injection is prevented to thereby obviate any non-uniform cooling of the pipe 10. Generally, a large part of the train produced during the cooling of a metal pipe is caused at temperatures in the plastic temperature range, and the strain caused by thermal expansion at temperatures in the elastic temperature range, which is lower than the plastic temperature range, can be ignored. Therefore, in the case of the ordinary steel having the carbon equivalent or $C_{eq}$ of about 0.4 %, the lower limit of temperatures related to the final strain of the steel is on the order of 400° C, and consequently the cooling from the temperature of 950° C to the lower limit temperatures has an important bearing on the steel. Thus, the present invention is directed to the adjustments in the temperature range between 400° and 950° C, and the cooling of steel to temperatures below 400° C has no important bearing.

As regards the above-mentioned formation of the swell 13 during the cooling of the outer periphery of a pipe, in the case of a metal pipe having a wall thickness of ½ inch and an outer diameter of 24 inches and which is processed at a feeding speed of 500 mm/min, the distance between the jetting points of the first-stage nozzle and the second-stage nozzles must be set at 90 mm.

Figure 6:
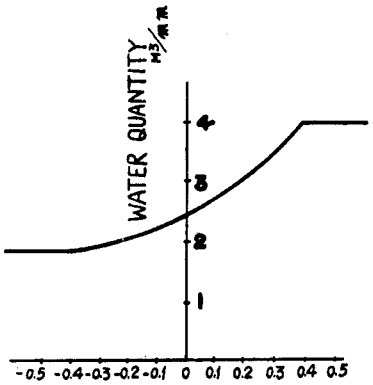
FIG. 6 is a graph showing the amount of cooling water to be adjusted in accordance with the detection of the detectors shown in FIG. 5.
Figure 5:
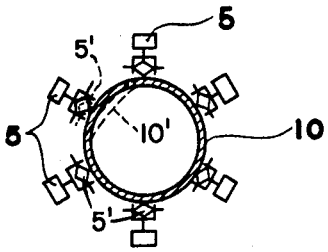
FIG. 5 is a schematic diagram showing a plurality of strain detectors with sensing elements arranged in place for detecting the strain on a pipe.
Figure 7:
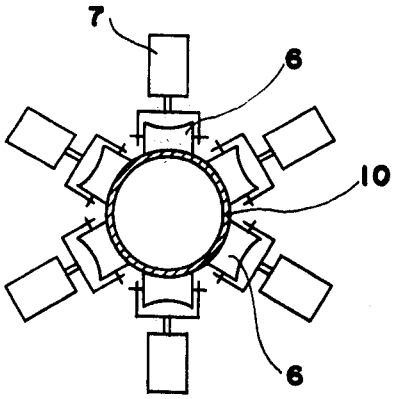
FIG. 7 is a front view of a back pinch rolls including clamping hydraulic cylinders whose clamping force is controlled in accordance with the measurement obtained by the strain detectors of FIG. 5.
Figure 8:
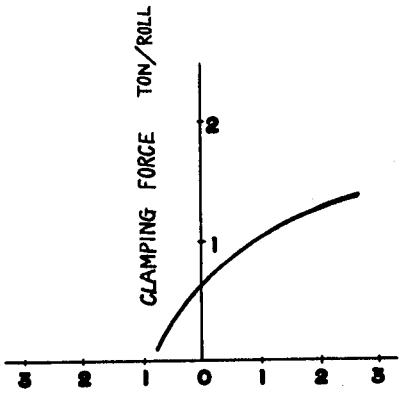
FIG. 8 is a graph showing the amount of clamping force required in accordance with the amount of deviation from the exact roundness of the pipe at the room temperature, with the required clamping force becoming smaller as the temperature of the pipe is reduced to 400° C and therebelow.

Next, the results of the experiments made with the present invention will now be described in greater detail. When a metal pipe of 12 m in length, ½ inch in wall thickness and 24 inches in outer diameter was quenched by using as the minimum water quantity the lower limit cooling rate of about 35° C/sec required for the quenching, and by spraying from the cooling nozzles the amount of water determined in accordance with the amount of strain from the exact round shape as shown in FIG. 6, the resulting out-of-roundness, or the difference between the maximum and minimum diameters was about 1.3 % of the diameter, the deflection of a position of the pipe 10 being shown in an exaggerated form as 10' in FIG. 5. This out-of-roundness or eccentricity was reduced to about 0.8 % when the above process was accomplished in combination with a forced correction in which the clamping force of the clamping hydraulic cylinders 7 was adjusted in accordance with the above-mentioned amount of strain as shown in FIG. 8.

Though not shown in the drawings, by arranging a plurality of multistage cooling nozzles in the rear of the back pinch rolls 6 and accomplishing the forced correction of the strain by the back pinch rolls 6 at temperatures near and below 400° C, and by arranging third-stage cooling nozzles 2' in the back of the multistage cooling nozzles, it is possible to accomplish the correction with a clamping force smaller than in the case of FIG. 8.

What is claimed:

1. A method of quenching a large-diameter thin-walled metal pipe comprising the steps of:

moving the metal pipe through a heating zone;

passing the pipe through a cooling zone following passage of the pipe through the heating zone, the cooling zone including a plurality of nozzles;

spraying a cooling liquid onto the pipe from the nozzles so as to quench the pipe at a velocity in the range of from 0.5 m/sec to 7 m/sec;

detecting the amount of strain on the outer periphery of the quenched pipe in a radical direction at a plurality of positions at the rear end of the cooling zone, as seen in the direction of movement of the pipe, to obtain a deviation of a detected value from a preset value; and adjusting the amount of cooling liquid sprayed on the pipe from the nozzles in accordance with the amount of deviation from the preset value, whereby the adjusted cooling water spray controls the deviation of the pipe emerging from the cooling zone.

2. A method according to claim 1 further comprising the step of controlling the pipe deviation by the application of a mechanical correcting force in dependence on the detected strain on the outer periphery of the quenched pipe.

3. A method according to claim 1 further comprising the step of detecting the amount of strain on the outer periphery of the pipe in a radial direction on a plurality of first positions on the pipe, and spraying cooling water on a plurality of second positions on the pipe, the second positions being in the vicinity of the first positions.

4. A method according to claim 1 further comprising the step of spraying the cooling liquid onto the pipe from nozzles disposed external to the pipe.

5. A method according to claim 1 further comprising the step of spraying the cooling liquid onto the pipe from nozzles disposed within the pipe.

6. A method according to claim 1 further comprising the step of spraying the cooling liquid onto the pipe under high pressure.

7. A method according to claim 6 further comprising the step of spraying a mixture of water and compressed gas onto the pipe.

8. A method according to claim 3 wherein the nozzles are disposed external to the pipe and include first and second nozzles disposed opposite one another, and further comprising the step of spraying cooling water onto the pipe from the first and second nozzles for the water jets from the first and second nozzles to impinge upon one another so as to form a swell of water over the pipe, whereby the water running down the pipe from the swell provides for a uniform cooling of the pipe.

* * * * *